US006877815B2

(12) United States Patent
Kassai et al.

(10) Patent No.: US 6,877,815 B2
(45) Date of Patent: Apr. 12, 2005

(54) SEAT OF CHILD-CARE INSTRUMENT

(75) Inventors: Kenzou Kassai, Osaka (JP); Ichiro Ohnishi, Nara (JP)

(73) Assignee: Aprica Kassai Kabushikikaisha, Osaka (JP)

( * ) Notice: Subject to any disclaimer, the term of this patent is extended or adjusted under 35 U.S.C. 154(b) by 0 days.

(21) Appl. No.: 10/765,453

(22) Filed: Jan. 26, 2004

(65) Prior Publication Data

US 2004/0195887 A1 Oct. 7, 2004

(30) Foreign Application Priority Data

Jan. 30, 2003 (JP) ..... 2003-022543

(51) Int. Cl.[7] ..... A47C 7/02
(52) U.S. Cl. ..... 297/452.46
(58) Field of Search ..... 297/452.42, 452.43, 297/452.46, 452.47, 452.15, 219.12, 229, 354.1, 250.1

(56) References Cited

U.S. PATENT DOCUMENTS

| | | | | | |
|---|---|---|---|---|---|
| 7,203 | A | * | 3/1850 | Gardner | 49/74.1 |
| 1,922,228 | A | * | 8/1933 | Brown | 267/145 |
| 3,209,380 | A | * | 10/1965 | Watsky | 5/724 |
| 3,381,999 | A | * | 5/1968 | Steere, Jr. | 297/452.47 |
| 3,818,522 | A | * | 6/1974 | Schuster | 5/652.1 |
| 3,895,841 | A | * | 7/1975 | Lebert | 297/464 |
| 4,413,857 | A | * | 11/1983 | Hayashi | 297/180.11 |
| 4,856,846 | A | * | 8/1989 | Lohmeyer | 297/285 |
| 4,892,356 | A | * | 1/1990 | Pittman et al. | 297/452.15 |
| 5,226,188 | A | * | 7/1993 | Liou | 5/653 |
| 6,027,137 | A | | 2/2000 | Rura | |
| 6,106,057 | A | | 8/2000 | Lee | |
| 6,283,347 | B1 | | 9/2001 | Roh | |
| 2004/0100050 | A1 | | 5/2004 | Kassai et al. | |

FOREIGN PATENT DOCUMENTS

| | | | |
|---|---|---|---|
| DE | 3536206 | | 4/1987 |
| DE | 29700919 | | 3/1997 |
| EP | 0041037 | * | 2/1981 |
| JP | 2000326778 | | 11/2000 |
| JP | 2001097226 | | 4/2001 |
| JP | 2002187554 | | 7/2002 |
| JP | 2002220050 | | 8/2002 |
| JP | 2003175827 | | 6/2003 |

* cited by examiner

*Primary Examiner*—Milton Nelson, Jr.
(74) *Attorney, Agent, or Firm*—W. F. Fasse; W. G. Fasse

(57) ABSTRACT

A seat of a child-care instrument comprises a seat plate, a backrest plate which can be reclined, and a lapping plate. The lapping plate integrally has a seat surface portion facing the seat plate, and a back surface portion facing the backrest plate. The seat plate and the backrest plate each have first openings penetrating in the thickness direction. The lapping plate has second openings penetrating in the thickness direction, in its seat surface portion and the back surface portion. The lapping plate is provided such that it can be displaced between a first position in which the first opening and second openings are aligned and a second position in which the positions of both openings are shifted. A plurality of hinge portions extending in the width direction are provided so as to be spaced in the vertical direction, in a corner region connecting the seat surface portion and the back surface portion of the lapping plate.

4 Claims, 4 Drawing Sheets

SEAT OF CHILD-CARE INSTRUMENT

CROSS-REFERENCE TO RELATED APPLICATION

This application is related to copending U.S. application Ser. No. 10/305,925, filed on Nov. 26, 2002 by the same Assignee as the present application. The entire disclosure of U.S. application Ser. No. 10/305,925 is incorporated herein by reference.

PRIORITY CLAIM

This application is based on and claims the priority under 35 U.S.C. §119 of Japanese Patent Application 2003-022543, filed on Jan. 30, 2003, the entire disclosure of which is incorporated herein by reference.

FIELD OF THE INVENTION

The present invention relates to a seat of a child-care instrument such as a baby carriage, a child safety seat, a baby chair/bed and the like and more particularly, it relates to a seat of a child-care instrument comprising a seat plate and a backrest plate which can be reclined.

DESCRIPTION OF THE BACKGROUND ART

It is desirable to provide a comfortable environment for a child seated in a seat, for example in developing a child-care instrument.

Ventilation is one of the factors providing the comfortable environment for the child. In summer or a humid season, the seat preferably has good ventilation to provide coolness for the child seated therein. Meanwhile, in winter or on cold and windy days, the seat preferably holds warmth by preventing a draft.

A child-care instrument satisfying the above requirements is the subject matter of the above mentioned U.S. application Ser. No. 10/305,925 as well as the corresponding Japanese Patent Application No. 2002-164436, filed on Jun. 5, 2002 and published in Japanese Laying-Open No. 2003-175827 on Jun. 24, 2003, which is owned by the same Assignee as the present application. In view of the publication date, this reference is not prior art against the present application, and it is cited herein merely as background information and as a starting point for the further development of the present invention.

An essential point of the invention disclosed in the above application is described with reference to present FIGS. 1 and 2. A wall forming a seat of the child-care instrument, a backrest wall, for example comprises a first plate member 1 and a second plate member 2 which are arranged to be overlapped. The first plate member 1 has many first openings 3 penetrating in the thickness direction and the second plate member 2 has many second openings 4 penetrating in the thickness direction.

The second plate member 2 is provided so as to be relatively changeable in position between a first position (a state shown in FIG. 2) in which the first openings 3 and the second openings 4 are aligned and a second position (a state shown in FIG. 1) in which positions of the first openings 3 and the second openings 4 are shifted.

According to the child-care instrument provided with the above constitution, when the second plate member 2 is held in the first position (the state shown in FIG. 2), since the wind comes through the first and second aligned openings 3 and 4, good ventilation can be provided. Meanwhile, when the second plate member 2 is held in the second position (the state shown in FIG. 1), since the first and second openings 3 and 4 are shut down and the wind does not come through the openings, heat can be well retained.

However, there is a point to be improved in the child-care instrument having the above constitution. This is described with reference to FIGS. 3 and 4 hereinafter.

A seat of a child-care instrument shown in FIG. 3 comprises a seat plate 5 having through holes 7 and a backrest plate 6 having through holes 8. The backrest plate 6 can be reclined.

In order to simplify a constitution for implementing ventilation, a lapping plate 10 is a sheet of a flat plate integrally comprising a seat surface portion 11 facing the seat plate 5 and a back surface portion 12 facing the backrest plate 6. The seat surface portion 11 of the lapping plate 10 has through holes 13 which can be aligned with the through holes 7 of the seat plate 5, and the back surface portion 12 of the lapping plate 10 has through holes 14 which can be aligned with the through holes 8 of the backrest plate 6. The back surface portion 12 of the lapping plate 10 is connected to a rear end portion of the seat surface portion 11 such that it can be bent in order to follow a reclining operation of the backrest plate 6.

There is a problem that in the case of the lapping plate 10 integrally comprising the seat surface portion 11 and the back surface portion 12, the lapping plate 10 is not smoothly moved in the vertical direction because of existence of a bending point between both. When the bending point is constituted so as to have an accordion structure in order to avoid forming a sharp corner part, the corner part becomes too flexible and the movement of the back surface portion 12 cannot be transmitted to the seat surface portion 11. In order to avoid the above problem, it is thought that the bending point is formed of a hard portion having a configuration drawing a gentle circular arc, but even in such case, the following problems arise.

According to the seat shown in FIG. 3, the through holes 8 of the backrest plate 6 and the through holes 14 of the back surface portion 12 of the lapping plate 10 are aligned, and the through holes 7 of the seat plate 5 and the through holes 13 of the seat surface portion 11 of the lapping plate 10 are aligned. Then, it is assumed that a reclining angle of the backrest plate 6 is changed while this aligned state of the through holes is maintained. In FIG. 4, a state in which the backrest plate 6 is relatively raised is shown by a solid line and a state in which it is reclined is shown by a dotted line.

FIG. 4 shows each member illustratively, in which a bending point and an end portion are made to be noticeable in order to easily understand its movement. More specifically, the seat plate 5 has a front point 16, and the backrest plate 6 has a rear point 17. The backrest plate 6 is reclined in such a manner that a connection point 15 becomes a bending center. The seat surface portion 11 of the lapping plate 10 has a front point 19, and the back surface portion 12 has a rear point 20. The back surface portion 12 is reclined in such a manner that a connection point 18 becomes a bending center. In the state shown by the solid line in FIG. 4, as a matter of convenience, a height of the rear point 17 of the backrest plate 6 is shown so as to be almost the same as that of the rear point 20 of the back surface portion 12, and a front position of the front point 16 of the seat plate 5 is shown so as to be almost the same as that of the front point 19 of the seat surface portion 11.

As the backrest plate 6 is reclined, the rear point 17 of the backrest plate 6 and the rear point 20 of the back surface portion 12 are both moved along a circular arc 21 in which the connection point 15 is the center of curvature and a length of the backrest plate 6 is a radius. In the state shown by the dotted line in FIG. 4, the connection point 18 between the back surface portion 12 and the seat surface portion 11 is positioned on a circular arc 22 in which the rear point 20 of the seat surface portion. 11 is the center of curvature and a length of the seat surface portion 12 is a radius. Therefore, as shown in FIG. 4, the connection point 18 is shifted by L before-and-after the reclining operation of the backrest plate 6.

Similarly, since the front point 19 of the seat surface portion 11 is positioned on a circular arc 23 in which the shifted connection point 18 is a bending center, it is displaced before-and-after the reclining operation of the backrest plate 6.

The following problems arise because of the above positional displacement. That is, as the backrest plate 6 is reclined in the state in which the through holes are aligned shown in FIG. 3, although the aligned state of the through holes 8 of the backrest plate 6 and the through holes 14 of the back surface portion 12 is maintained after the reclining operation, the positions of the through holes 7 of the seat plate 5 and the through holes 13 of the seat surface portion 11 are displaced after the reclining operation, so that the ventilation is inhibited. On the contrary, as the backrest plate 6 is reclined in the state in which the through holes 7 of the seat plate 5 and the through holes 13 of the seat surface portion 11 are shut down, positions of both through holes could coincide with each other despite the intention.

SUMMARY OF THE INVENTION

The present invention was made so as to solve the above problems and it is an object of the present invention to provide a seat of a child-care instrument in which a lapping plate integrally comprising a seat surface portion and a back surface portion can be smoothly moved and when a backrest plate is reclined, a state of ventilation and shutoff state of the ventilation can be stably maintained.

A seat of a child-care instrument according to the present invention basically comprises a seat plate and a backrest plate which can be reclined. Such seat further comprises a lapping plate integrally having a seat surface portion facing the seat plate and a back surface portion facing the backrest plate. The seat plate and the backrest plate each have first openings penetrating in the thickness direction. The lapping plate has second openings penetrating in the thickness direction in its seat surface portion and back surface portion and it is provided such that it can be displaced between a first position in which positions of the first and second openings are aligned and a second position in which positions of the first and second openings are shifted. A plurality of hinge portions extending in the width direction are provided so as to be spaced in the vertical direction, in a corner region connecting the seat surface portion and the back surface portion of the lapping plate.

According to the seat with the above constitution, since the corner region ham a configuration of a gentle circular arc because of the plural hinge portions, and the movement of the back surface portion can be effectively transmitted to the seat surface, portion, the lapping plate integrally comprising the seat surface portion and the back surface portion can be smoothly moved. In addition, although there is generated positional displacement at a lower end of the back surface portion of the lapping plate in accordance with a reclining operation of the backrest plate, since this positional displacement can be absorbed by the plural hinge portions provided in the corner region, a positional relation between the seat plate and the seat surface portion of the lapping plate can be stably maintained. Therefore, a state of ventilation and a shutoff state of the ventilation in the seat portion and the backrest portion can be stably maintained.

Preferably, the plural hinge portions are formed of thinned portions reduced in thickness of the lapping plate. In this case, the thinned portion is formed by cutting in a back surface of the lapping plate. Thus, there is provided a very simple structure.

The lapping plate is provided such that it can be slid along the seat plate and the backrest plate. Its sliding direction is the vertical direction or lateral direction, for example.

DESCRIPTION OF THE PREFERRED EMBODIMENTS

Figure 1:
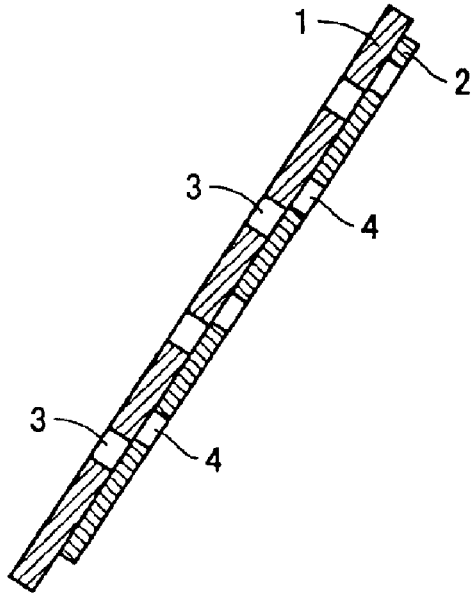
FIG. 1 is a view showing a substantial point according to the invention disclosed in Japanese Patent Application No. 2002-164436.
Figure 2:
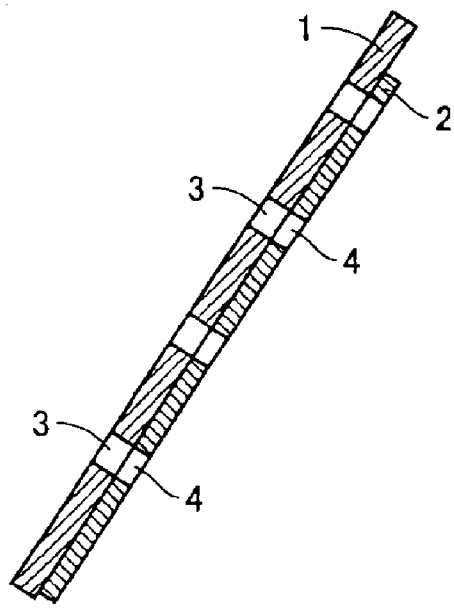
FIG. 2 is a view showing a state in which one plate member is moved in the vertical direction from a state shown in FIG. 1.
Figure 3:
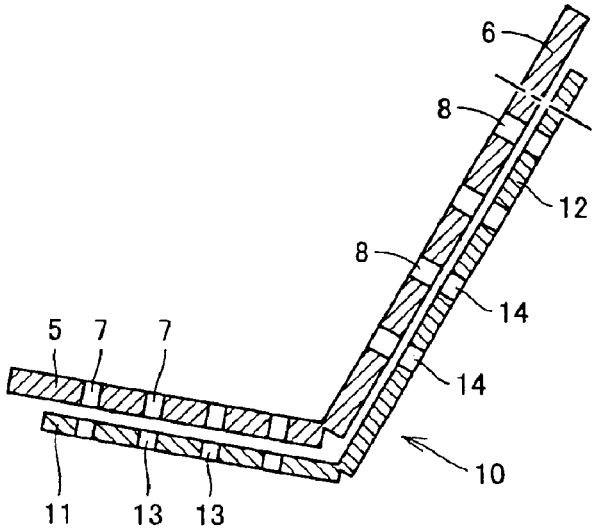
FIG. 3 is a sectional view showing a state in which a lapping plate is provided along a seat forming member.
Figure 4:
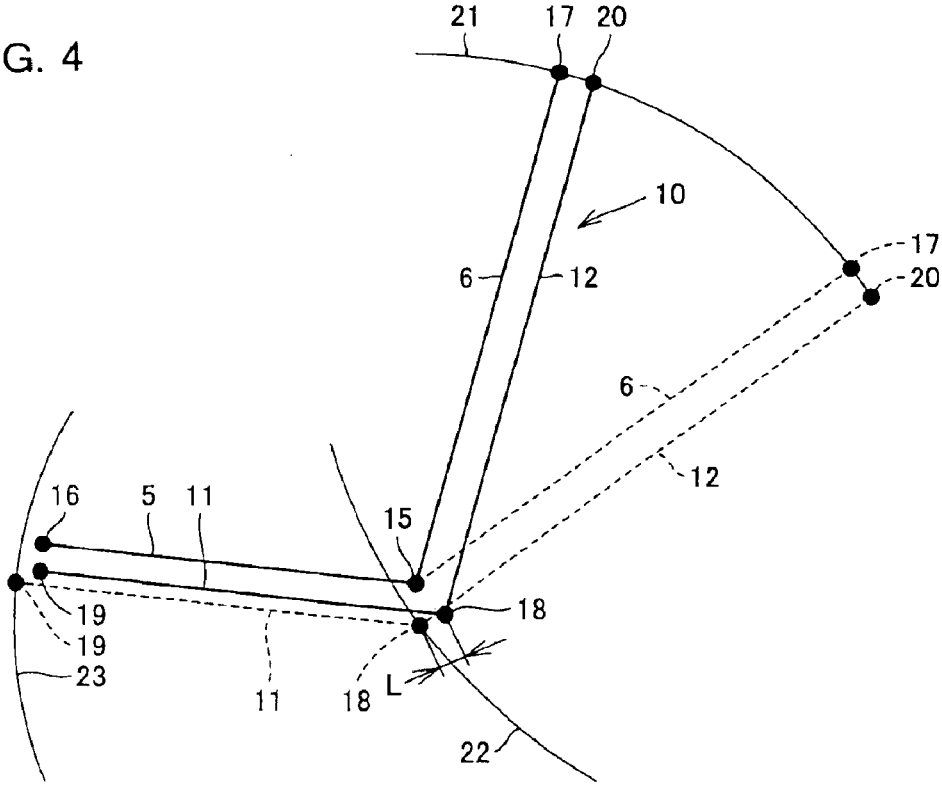
FIG. 4 is a view for explaining positional displacement in a seat surface portion of a lapping plate when a backrest plate is reclined.
Figure 5:
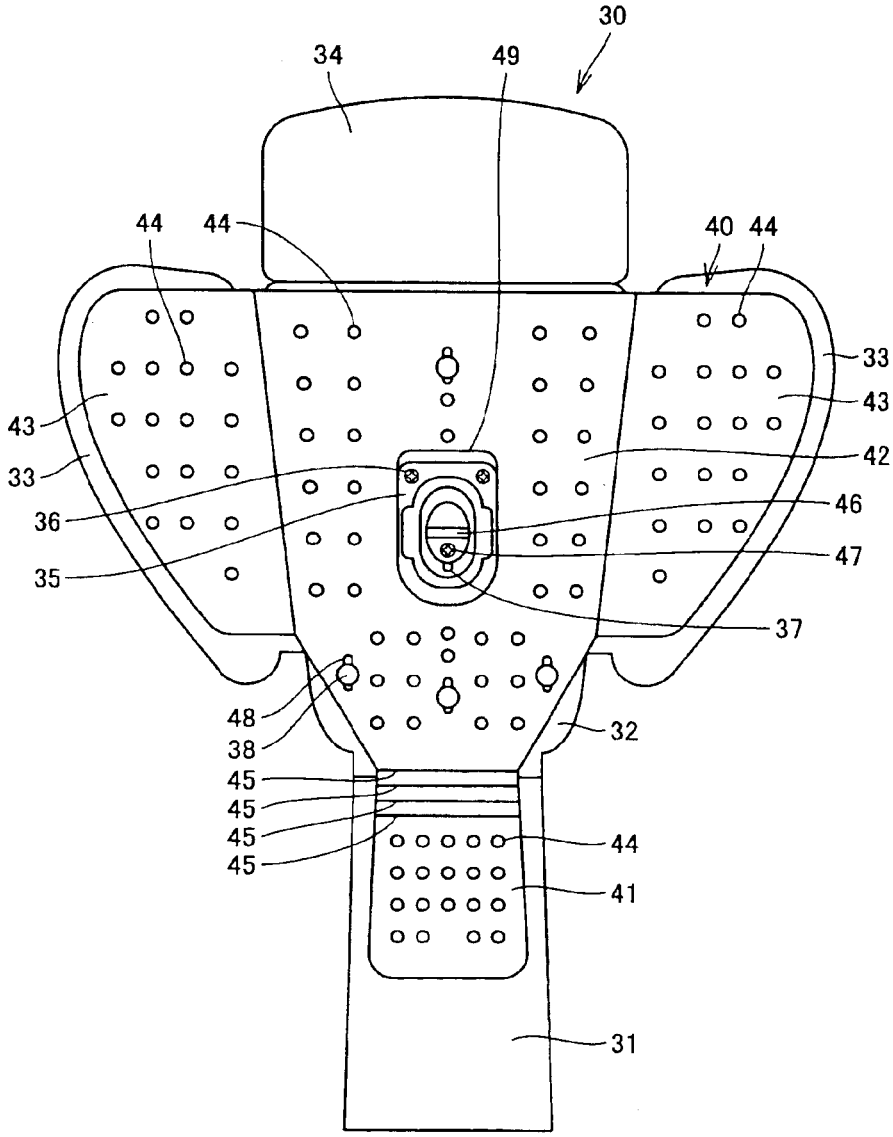
FIG. 5 is a back view showing an embodiment of the present invention.

FIG. 5 shows an embodiment of the present invention. An illustrated seat forming member 30 is a core mounted on a body of a baby carriage to form a seat and integrally comprises a seat plate 31, a backrest plate 32, a pair of side plates 33 extending sideward from both side edges of the backrest plate 32 and a head guard 34 extending upward from the upper edge of the backrest plate 32.

According to the baby carriage on which the seat forming member 30 is mounted, a backrest portion can be reclined. The seat forming member 30 may be used as a core of a cloth seat hammock mounted on the body of a baby carriage or may be directly mounted on the body without the seat hammock.

FIG. 5 shows a back side of the seat forming member 30 horizontally exploded. When the seat forming member 30 is mounted on the baby carriage and used in a form of a chair state, the backrest plate 32 rises upward from a rear edge of the seat plate 31. Alternatively, when the baby carriage is used in a form of a bed state, the pair of side plates 33 rises upward from both side edges of the backrest plate 32 and the head guard plate 34 rises upward from the upper edge of the backrest plate 32.

As shown in FIG. 5, a lapping plate 40 is mounted on the back surface of the seat forming member 30. The lapping plate 40 integrally comprises a seating surface portion 41 facing the seat plate 31, a back surface portion 42 facing the backrest plate 32 and side surface portions facing the pair of side plates 33.

Through holes 44 for ensuring ventilation of the seat are formed in each portion of the lapping plate 40, that is, the seat surface portion 41, the back surface portion 42 and the side surface portions 43. Through holes which can be aligned with the through holes 44 of the lapping plate 40 are formed in the seat plate 31, the backrest plate 32 and the side plates 33 of the seat forming member 30 although they are not shown in the drawing because of the lapping plate 40.

The lapping plate 40 is provided such that it can be displaced between a first position in which the through holes 44 of the lapping plate and the through holes of the seat forming member 30 are aligned and a second position in which the positions of those through holes are shifted. According to the illustrated embodiment, the lapping plate 40 can be slid in the vertical direction by a predetermined distance.

A concrete constitution to make the lapping plate 40 slide is described hereinafter.

The back surface portion 42 of the lapping plate 40 has a central opening 49 in nearly the center thereof. A plate 35 is mounted on almost the center of the backrest plate 32 of the seat forming member 30 by a setscrew 36 passing through the central opening 49. The back surface portion 42 of the lapping plate 40 has a portion sandwiched between the plate 35 and the backrest plate 32 and a knob 46 is mounted on this portion through the setscrew 47. The knob 46 is positioned on the plate 35, and a longitudinal hole 37, through which the setscrew 47 extends, is formed in the plate 35.

In addition, longitudinal holes 48 which are long in the vertical direction are formed in places of the back surface portion 42 of the lapping plate 40. Corresponding these holes, buttons 38 each having axes penetrating the longitudinal hole 48 are fixed to the backrest plate 32. Since the back surface portion 42 of the lapping plate is sandwiched between the button 38 and the backrest plate 32, it can always keep in close contact with the backrest plate 32. The back surface portion 42 of the lapping plate 40 can be slid in the vertical direction within a range in which the setscrew 47 can move in the longitudinal hole 37 and within a range in which the axis of the button 38 can move in the longitudinal hole 48. In addition, the longitudinal holes 48 and the buttons 38 are provided also in the seat surface portion 41 and side surface portion 43 of the lapping plate 40 and the seat plate 31 and side plate 33 although they are not shown in the drawing.

When the lapping plate 40 is slid in the vertical direction, the knob 46 is moved in the vertical direction by fingers. Since the knob 46 and the lapping plate 40 are connected, the lapping plate 40 is moved in the vertical direction in accordance with the movement of the knob 46.

In addition, the lapping plate 40 can be fixed at a predetermined position by locking the position of the knob 46. As a locking mechanism for the knob 46, since various kinds of structures can be employed, a detailed description thereof is omitted here.

As described above, when ventilation is desired or when shutoff of the ventilation is desired, the lapping plate 40 is moved by operating the knob 46.

Figure 6:
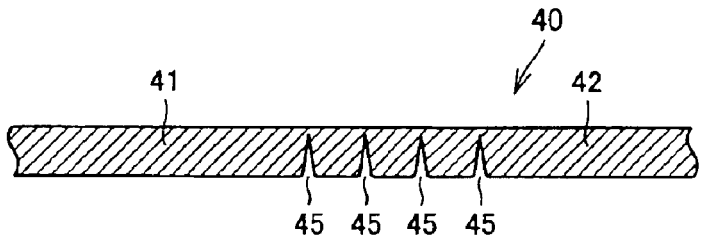
FIG. 6 is an enlarged sectional view showing a corner region of the lapping plate.

As shown in FIGS. 5 and 6, a plurality of hinge portions 45 extending in the width direction are provided so as to be spaced in the vertical direction, in a corner region connecting the seat surface portion 41 and the back surface portion 42 of the lapping plate 40. The lapping plate 40 is formed of a synthetic resin, for example and each hinge portion 45 is formed of a thinned portion reduced in thickness of the lapping plate 40.

Since the back surface portion 42 of the lapping plate 40 rises frontward, the thinned portion is provided by cutting in the back surface of the lapping plate 40 as shown in FIG. 6.

Figure 7:
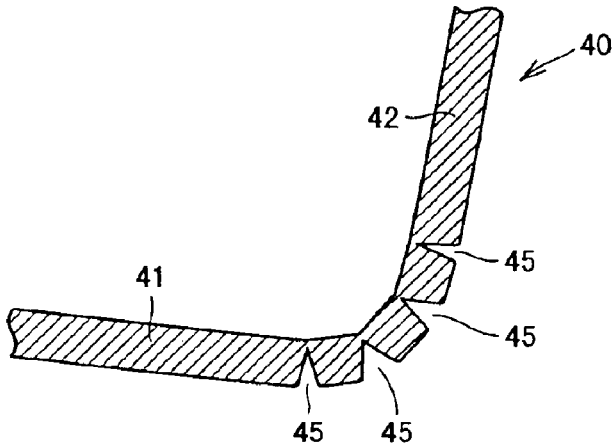
FIG. 7 is a sectional view showing a state in which a back surface portion of the lapping plate is raised.
Figure 8:
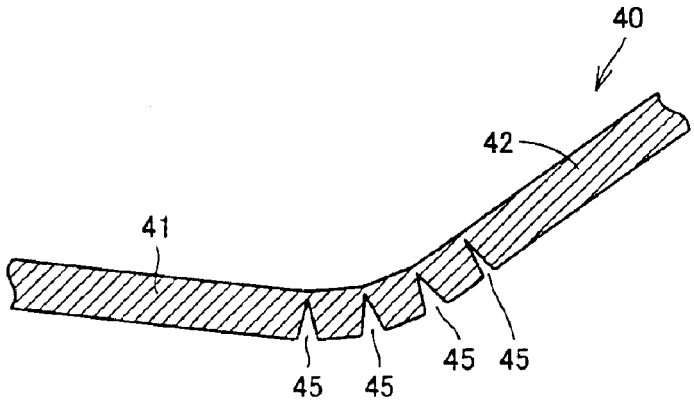
FIG. 8 is a sectional view showing a state in which the back surface portion is reclined from the state shown in FIG. 7.

FIGS. 7 and 8 show the corner region of the lapping plate 40. FIG. 7 shows a state in which a reclined angle of the back surface portion 42 is small and FIG. 8 shows a state in which the reclined angle of the back surface portion 42 is large. As described above, when the backrest plate 32 is reclined, the lower edge of the back surface portion 42 of the lapping plate 40 is displaced. This positional displacement is absorbed by the plural hinge portions provided in the corner region. More specifically, when the state shown in FIG. 7 is moved to the state shown in FIG. 8, the cutting width of each hinge portion 45 is reduced to absorb the positional displacement. In order to effectively absorb such positional displacement, it is necessary to provide the plural hinge portions 45. According to the illustrated embodiment, there are four hinge portions.

Since there are the plural hinge portions 45, the corner region of the lapping plate 40 can form a smooth circular arc. The vertical movement of the back surface portion 42 is surely transmitted to the seat surface portion 41 through the plural hinge portions 45. In addition, even when the backrest plate 32 is reclined, a positional relation between the seat surface portion 41 of the lapping plate 40 and the seat plate 31 can be stably maintained because of the above absorption effect of the positional displacement by the plural hinge portions 45. Therefore, the ventilation state and the shutoff state of the ventilation in the seat portion and backrest portion can be stably maintained.

Furthermore, the same plural hinge portions as the above described hinge portions 45 may be provided in a corner region connecting the back surface portion 42 and the pair of side surface portions 43 of the lapping plate 40.

Although one embodiment of the present invention was described with reference to the drawings, the above described and illustrated embodiment only shows the present invention illustratively. Therefore, various kinds of modifications and variations can be added within the same scope or an equivalent scope as in the present invention. Some of them are illustratively listed and described hereinafter.

(1) Although the seat forming member 30 comprises the pair of side plates 33 and the head guard plate 34 besides the seat plate 31 and the backrest 32 in the illustrated embodiment, the seat forming member may not have the side plates 33 and the head guard plate 34.

(2) In addition, although the lapping plate 40 comprises the pair of side surface portions 43 besides the seat surface portion and the back surface portion 42 in the illustrated embodiment, the lapping plate may not have the side surface portions 43.

(3) The sliding direction of the lapping plate 40 is not limited to the vertical direction and may be the lateral direction (width direction). Alternatively, a displacement mechanism other than sliding may be employed.

(4) Although the openings for securing ventilation are in the form of the through holes in the illustrated embodiment, they may take other forms. For example, they may be notches extending from both side portions of the plate member to the center.

(5) As the child-care instrument to which the present invention can be applied, it is not limited to the baby carriage and it can be a child safety seat or a baby chair/bed.

What is claimed is:

1. A seat of a child-care instrument provided with a seat plate and a backrest plate which can be reclined, comprising:

a lapping plate integrally having a seat surface portion facing said seat plate and a back surface portion facing said backrest plate, wherein said seat plate and said backrest plate each have first openings penetrating through a respective thickness thereof, said lapping plate has second openings penetrating through a thickness thereof, in the seat surface portion and the back surface portion, and is provided such that said lapping plate can be displaced between a first position in which positions of said first and second openings are aligned and a second position in which positions of said first and second openings are shifted, and a plurality of hinge portions extending in a width direction of said lapping plate are provided so as to be spaced in a longitudinal direction of said lapping plate, in a corner region connecting the seat surface portion and the back surface portion of said lapping plate.

2. The seat of the child-care instrument according to claim 1, wherein said plural hinge portions are formed of thinned portions reduced in thickness of the lapping plate.

3. The seat of the child-care instrument according to claim 2, wherein said thinned portion is formed by cutting in a back surface of said lapping plate.

4. The seat of the child-care instrument according to claim 1, wherein said lapping plate is provided such that it can be slid along said seat plate and said backrest plate.

* * * * *